United States Patent [19]

Bond et al.

[11] Patent Number: 4,993,237

[45] Date of Patent: Feb. 19, 1991

[54] SELF-COOLING CONTAINERS

[75] Inventors: James R. Bond, Vancouver, Canada; Scott V. Murray, Huntington Beach, Calif.

[73] Assignee: Heritage Ventures U.S., Ltd., Las Vegas, Nev.

[21] Appl. No.: 410,690

[22] Filed: Sep. 21, 1989

[51] Int. Cl.[5] ..... F25D 3/10

[52] U.S. Cl. ..... 62/294; 62/4; 62/394; 62/400

[58] Field of Search ..... 62/4, 294, 399, 530, 62/394, 400

[56] References Cited

U.S. PATENT DOCUMENTS

| | | | |
|---|---|---|---|
| 3,229,478 | 1/1966 | Alonso | 62/530 |
| 4,407,356 | 10/1983 | De Lau | 62/399 |
| 4,599,872 | 7/1986 | Rist | 62/399 |
| 4,669,273 | 6/1987 | Fischer et al. | 62/294 |
| 4,784,678 | 11/1988 | Rudick et al. | 62/4 |
| 4,802,343 | 2/1989 | Rudick et al. | 62/294 |

*Primary Examiner*—Albert J. Makay

*Assistant Examiner*—John Sollecito

*Attorney, Agent, or Firm*—Leonard Tachner

[57] ABSTRACT

The structure of the present invention comprises a self-cooling container in which a segregating wall is used to divide the container into a beverage chamber and a cooling chamber, the latter having a reaction chamber mounted therein, which in a preferred embodiment is of an elongated cylindrical shape. The reaction chamber cylinder of the present invention provides an inverted funnel-shaped bottom surface for receiving the flow of beverage from the beverage chamber portion of the container through a feed-through at the bottom of the segregating wall thereof. The funnel leads to a flow tube which is positioned in axial alignment with the cylinder, preferably through the center thereof and defining an inner wall of the reaction chamber. The reaction chamber houses a combination of chemical materials separated by a readily broken sealing device from a selected volume of distilled water, which rfe-leased into the chemical constituents, initiates an endothermic reaction which extracts heat from the beverage.

23 Claims, 4 Drawing Sheets

SELF-COOLING CONTAINERS

BACKGROUND OF THE INVENTION

1. Field of the Invention

The present invention relates generally to self-cooling containers of the type that are used for holding beverages such as soft drinks, fruit juices, beer and the like and more specifically to such self-cooling containers with improved thermodynamic efficiency utilizing a beverage flow path that is surrounded by a combination of materials in endothermic reaction.

2. Prior Art

The most relevant prior art patent known of by the applicants herein is U.S. Pat. No. 4,802,343 to Rudick et al. This patent discloses a number of alternative embodiments of self-cooling containers wherein the principal features appears to be a directing means for directing the flow of a portion of the beverage in the container in contact with the cooling chamber to cool predominantly the next to be consumed portion of the beverage. Various embodiments shown in that patent differ one to the next, principally in the shape and location of such directing means and of the cooling chamber and the endothermic contents thereof. However, in all of the embodiments disclosed in the aforementioned U.S. Pat. No. 4,802,343, the directing means causes the beverage to be cooled by flowing between the directing means and the endothermic chemical combination so that the beverage effectively flows only along one surface of the cooling chamber resulting in less than optimum heat transfer from the beverage to the cooling chamber. As a result, the various alternate embodiments shown in the aforementioned prior art patent are not likely to cool to the extent that is desireable and may additionally require some form of insulation along the surface of the container in order to attain even a minimum degree of cooling sufficient to satisfy the user.

Other known U.S. Patents of some relevance include:

U.S. Pat. No. 3,229,478 to Alonso

U.S. Pat. No. 4,599,872 to Rist

U.S. Pat. No. 4,669,273 to Fischer et al

U.S. Pat. No. 4,784,678 to Rudick et al

SUMMARY OF THE INVENTION

The present invention overcomes the noted deficiencies of the most relevant prior art, principally by providing a path in the form of a feed-through tube which channels the beverage to be cooled through the chemical combination undergoing an endothermic reaction. In this manner, the beverage to be cooled is surrounded entirely by what amounts to a cooling jacket, but without permitting the beverage to come in physical contact with any of the chemical reactants. This feed-through tube is provided in the form of a tube positioned substantially along the axis of a reaction chamber cylinder which sits vertically within the container, such as a can, parallel to the axis of the can and within a chamber segregated from the remaining portion of the can by a shaped wall which serves a dual purpose. More specifically, the shaped wall serves a first purpose of segregating the majority of the contents of the can from the portion of the beverage that is within the cooling chamber. Additionally, the shaped wall serves a second purpose, namely, to channel the yet uncooled beverage in a controlled manner into the by means of an aperture in the shaped wall that leads to an inverted funnel configuration at the base of the aforementioned reaction chamber cylinder as will be hereinafter more fully described. The top of the channel terminates in a collection chamber adjacent the top of the can immediately below the user openable closure. The reaction chamber uses a breakaway seal to separate a liquid such as distilled water, from the remaining chemical reactants until the seal is opened by a rod which may be selectively depressed at the can top by the user.

OBJECTS OF THE INVENTION

It is therefore a principal object of the present invention to provide an improved self-cooling container of the type that utilizes a selectively initiated endothermic chemical reaction and which provides a structure for passing a beverage to be dispensed from the container along a surface of the endothermic chemical reaction chamber in order to cool the liquid.

It is an additional object of the present invention to provide an improved self-cooling container of the type having a beverage to be dispensed therefrom and providing a structure wherein the beverage flow is entirely jacketed by a chamber containing an endothermic chemical reaction for cooling the beverage flowing therethrough.

It is still an additional object of the present invention to provide an improved self-cooling container such as beverage cans and the like wherein more efficient cooling is provided by a structure comprising a cylindrically shaped endothermic chemical reaction chamber having a flow channel therethrough, the bottom of which flares out into an inverted funnel-shaped entry point for receiving a beverage, the beverage can being segregated into a cooling chamber side and a beverage storage side by a selectively shaped wall structure having an aperture adjacent the inverted funnel entrance to the cooling chamber.

It is still an additional object of the present invention to provide an improved self-cooled beverage container, wherein a conventionally shaped beverage can is provided with a segregating wall forming a cooling compartment having a flow structure containing endothermic chemically reactive materials that may be selectively reacted by the user and wherein both the segregating wall and the endothermic reaction containing chamber are affixed to the top of the can for ease and simple low cost mass production using conventional machinery.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
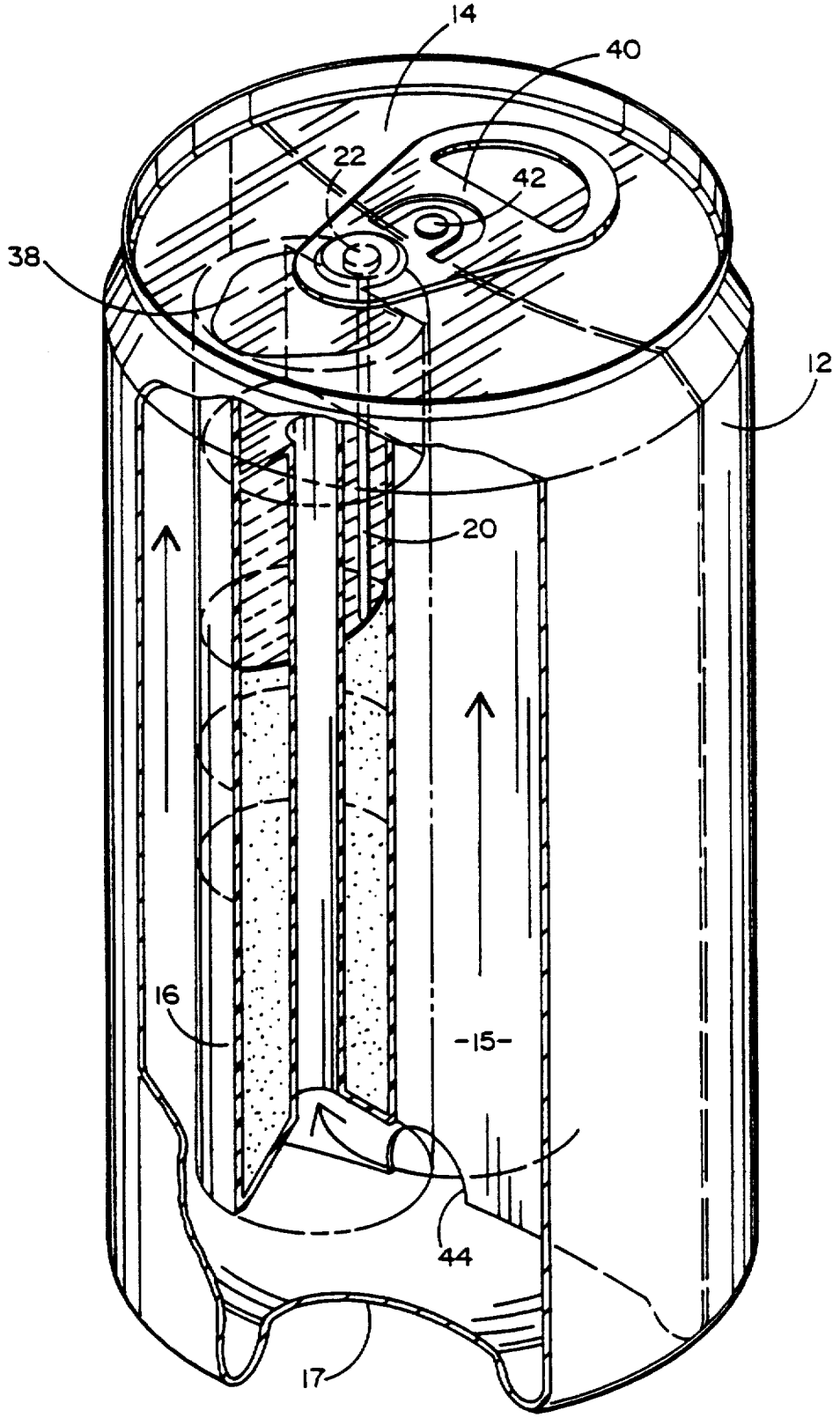
FIG. 1 is a partially cross-sectioned isometric view of a preferred embodiment of the present invention shown installed in an aluminum can configuration.
Figure 2:
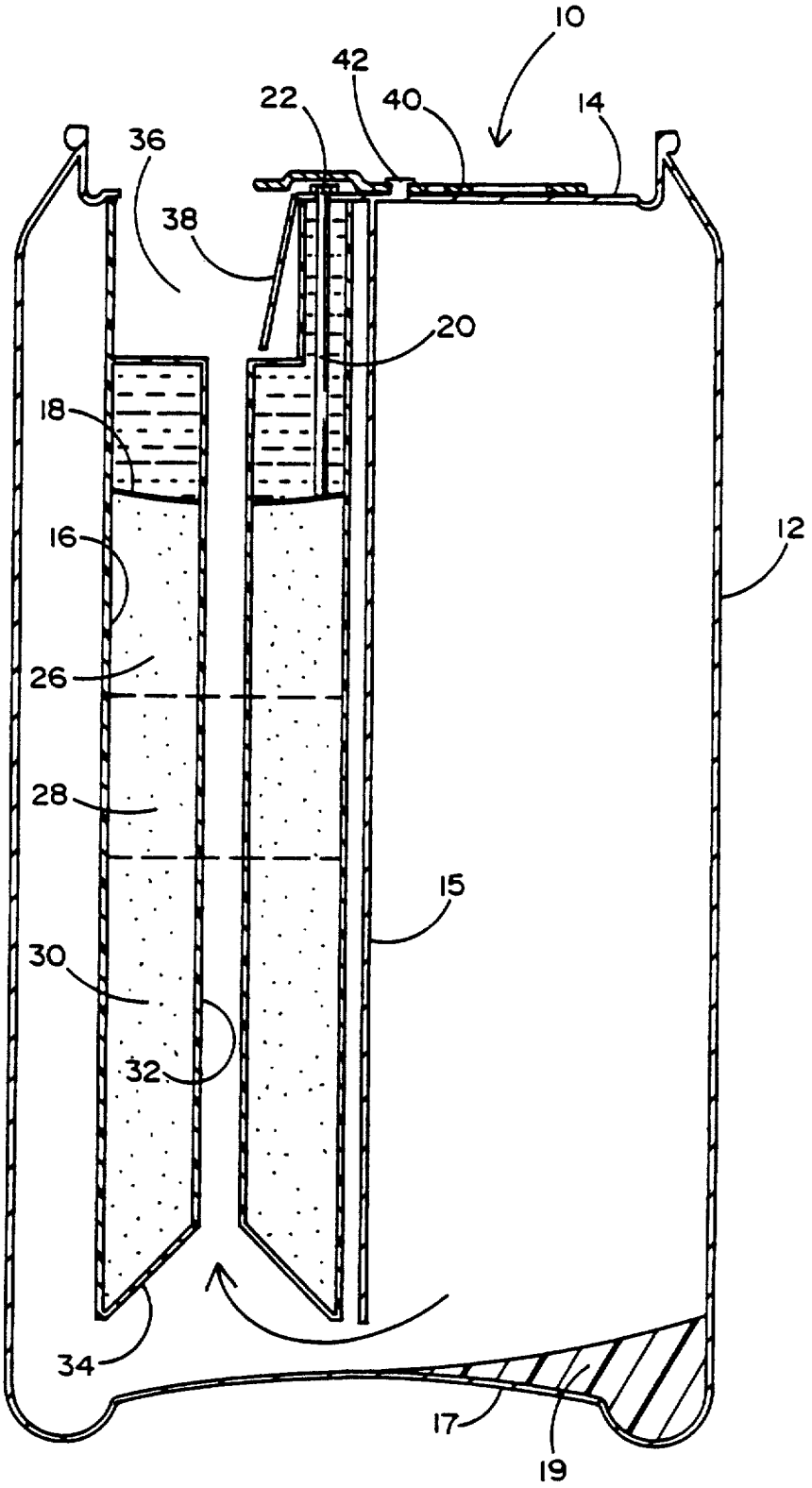
FIG. 2 is a cross-sectional plan view of the aluminum can configuration embodiment of the invention shown in FIG. 1.
Figure 3:
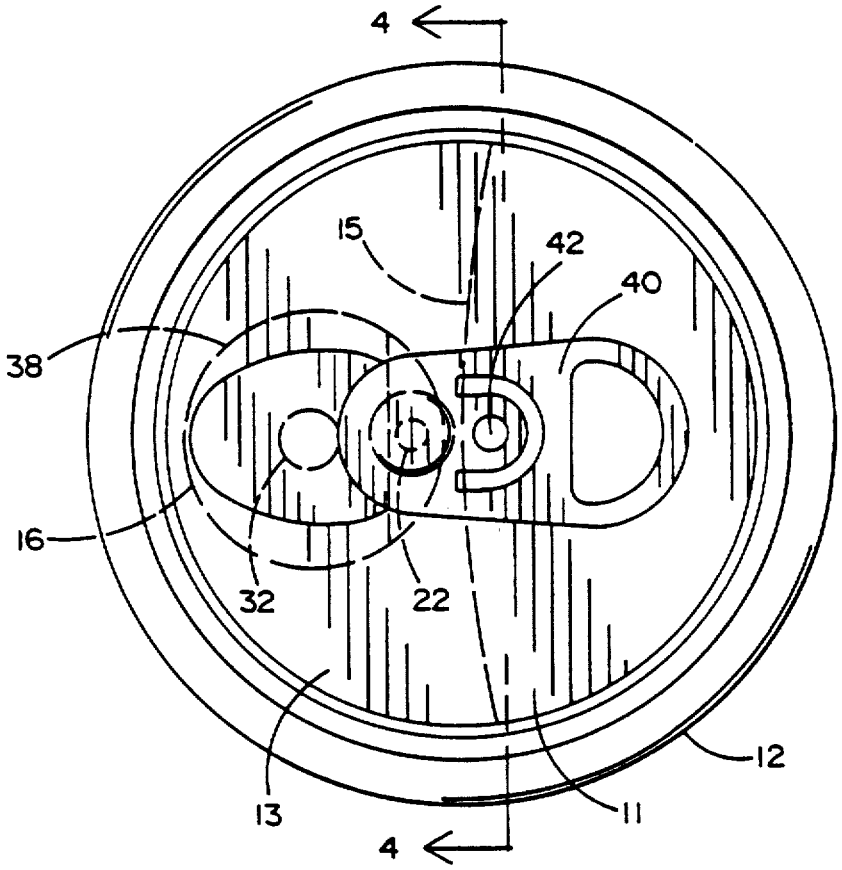
FIG. 3 is a top, partially cross-sectioned view of the embodiment shown in FIG. 1.
Figure 4:
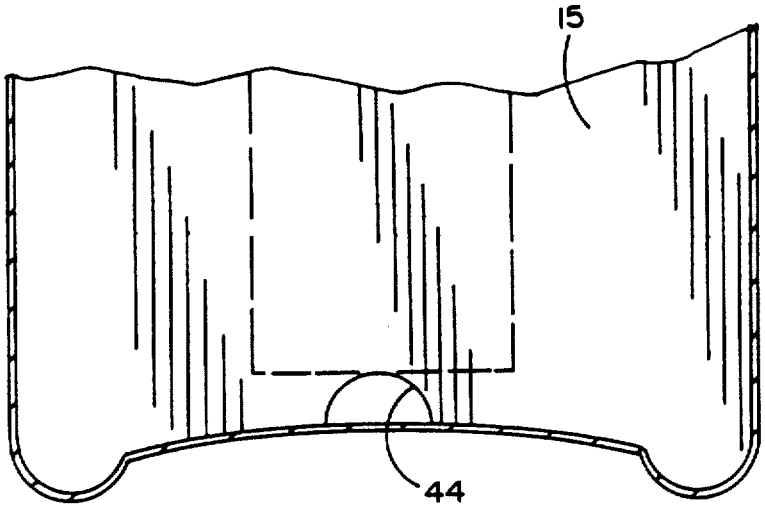
FIG. 4 is a plan view of the lower portion of the segregating wall of the present invention.
Figure 5:
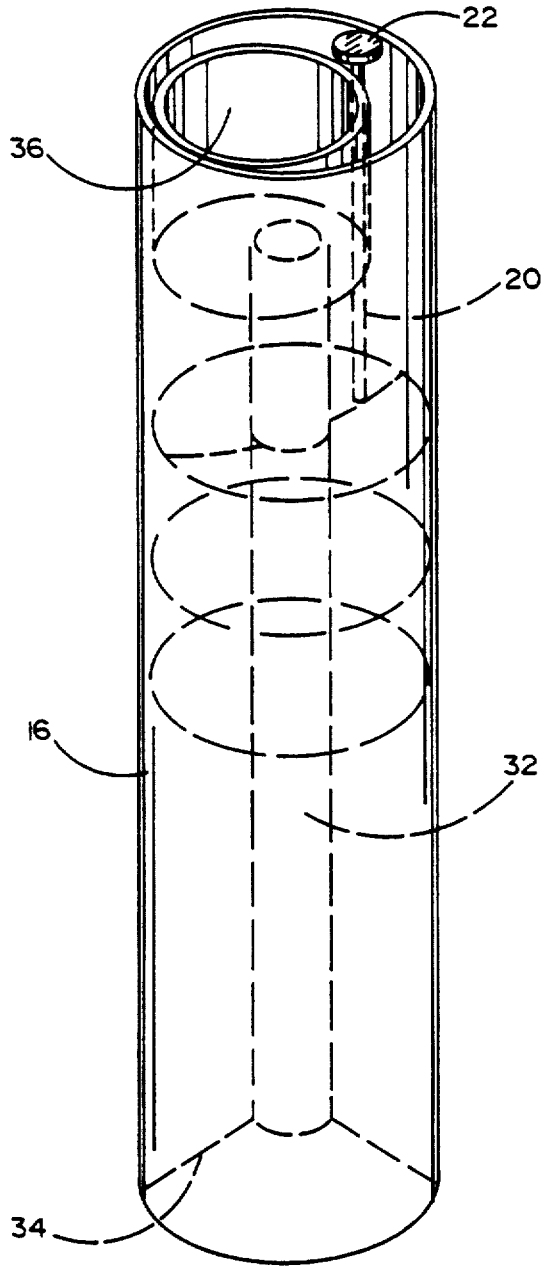
FIG. 5 is an isometric view of the endothermic reaction chamber and beverage flow structure of the present invention.

Referring now first to FIGS. 1, 2 and 3, it will be seen that the self-cooling container 10 of the present invention comprises a radial wall 12, a top 14 and a bottom 17 forming an interior which is divided by a segregating wall 15 into a beverage chamber 11 and a cooling chamber 13. A reaction chamber 16 is positioned within the cooling chamber 13. In the preferred embodiment illustrated in the accompanying drawings, reaction chamber 16 comprises an elongated cylindrically-shaped structure providing an axially directed flow channel or tube 32, the lower end of which is shaped to form a funnel inlet 34 and the upper end of which terminates in a collection chamber 36. Reaction chamber 16 is segregated longitudinally along its axis by a breakaway seal 18 above which is stored a preselected volume of distilled water or other liquid suitable for interacting with chemical constituents contained within the reaction chamber below the breakaway seal 18 for initiating the endothermic chemical reaction for cooling the beverage. In the particular embodiment shown herein, the endothermic chemical materials which are sequentially positioned within the lower portion of reaction chamber 16, comprise ammonium nitrate 26, potassium perchlorate 28 and urea 30 in a volume ratio of two to one to three respectively. It will be understood however, that the particular chemical reactants that may be used in the present invention and the respective quantities or ratios thereof, are not necessarily limited to those particular ones described herein. It is well-known in the art that there are numerous chemical combinations, the constituents of which, when caused to react with one another, create an endothermic chemical reaction which will absorb heat and thereby cool adjacent substances.

Figure 6:
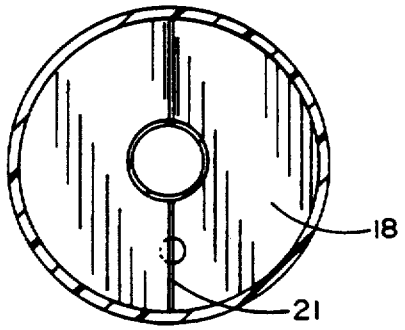
FIG. 6 is a plan view of a breakaway disk used in the structure of FIG. 5 for initiating the endothermic reaction therein.

In the present invention and in particular in the preferred embodiment of the invention shown herein, the chemical constituents beneath the breakaway seal 18 are all substantially dormant and remain so until the seal 18 is broken, thereby releasing the distilled water 24 which carries the various constituents of the endothermic reaction into solution and chemical combination. Releasing the distilled water 24 from the upper portion of reaction chamber 16 is accomplished by an initiating rod 20 which, as seen best in FIG. 2, extends from the top 14 of the container 10 where the end thereof is held in place by a cap 22 which is exposed above the top 14 after the user has selectively opened the can top by utilizing a conventional prying device 40 and a fulcrum 42 to release a closure 38 in a well-known manner. The initiating rod 20 is long enough to extend substantially to the breakaway seal 18 shown in FIG. 6 and specifically a seam 21 therein. Seam 21 is designed to be readily punctured and thereby opened when the user depresses the cap 22, thereby pushing the initiating rod 20 down into more forceful engagement with the seal 18.

Although it is relatively simple to adapt the initiating rod 20 so that it is the pressed automatically upon opening the closure 38, in the preferred embodiment of the invention herein, it is deemed desireable to allow the user the choice of either depressing or not depressing cap 22 of initiating rod 20 to initiate the endothmeric chemical cooling after opening the container. Thus for example, it may be desireable where the container of the present invention has been refrigerated before opening, to activate the self-cooling feature sometime after the container has been initially opened and the beverage therein has been allowed to warm to some higher ambient temperature. In either case, when the user depresses the cap 22, thereby activating the endothermic chemical reaction within reaction chamber 16, the distilled water 24 saturates the ammonium nitrate 26, dropping the ambient temperature of the distilled water to near freezing. The potassium perchlorate 28 turns into a slurry. Then the Urea 30 drops the temperature within the chamber to below 20 degrees Fahrenheit. At this time the potassium perchlorate, which does not go into solution, acts as a damper in the reaction and takes on the physical characteristics of a gel, keeping the temperature down below freezing for a period longer than twenty minutes. Within about two minutes from the time the user depresses cap 22 and allows the distilled water to saturate the ammonium nitrate, the reaction chamber 16 will have lowered the temperature of the portion of the beverage contained within flow tube 32 to about fifty degrees Fahrenheit or less.

When the user wishes to drink from the can 10, he or she tilts the container in a normal beverage drinking fashion, emptying the contents of the flow tube 34 into the collection chamber 36 and out through the closure 38. When the can is placed in an upright position, the beverage again flows from the beverage chamber 11 to the cooling chamber 13 through the feed-through 44 of segregating wall 15, at least to the height of the beverage remaining in beverage chamber 11. As the volume of fluid in container 10 is gradually reduced, the cooling efficiency, that is the efficiency of heat transfer between the smaller volume of beverage within reaction chamber 16, increases, thereby reducing the temperature of the fluid faster and eventually reducing the temperature of the fluid remaining in the entire container. In a test conducted by the applicant herein, using a prototype of the invention herein disclosed, the temperature of the beverage within container 10 over a period of two minutes and twenty minutes, after activating the initiating rod 20, measured between fifty and forty-five degrees Fahrenheit despite the fact that it was initially at an ambient temperature level of approximately seventy degrees before the self-cooling feature was activated.

Although the actual size of container 10 and the volume of beverage contained therein may vary, in a prototype configuration which contained approximately twelve ounces of beverage, the reaction chamber 16 contained forty milliliters of distilled water, thirty milliliters of ammonium nitrate, fifteen milliliters of potassium perchlorate and forty-five milliliters of urea. The flow tube 32 and funnel inlet 34 were designed to collect and hold approximately forty-five milliliters of the beverage and the collection chamber 36 was designed to hold approximately fifteen milliliters of the beverage. It will be understood however, that the precise volumes noted herein are disclosed by way of example only and that variations in volume, shape and configuration may be readily made to provide maximum cooling efficiency for the container size, shape and materials contemplated for use in each case.

In the preferred embodiment of the invention shown herein, the reaction chamber 16 and the segregating wall 15 may be made of either plastic or metal and are preferably configured to be attached to the container top 14 prior to assembly of the container so that such assembly may be carried out in a conventional manner using existing mass production machinery that would otherwise be used for securing the radial wall 12 and the top 14 of a conventional container. It should also be pointed out that the design of the present invention does not permit, any physical interaction between the beverage and the chemical contents of the reaction chamber 16. Nevertheless, it by chance, such interaction were to occur and a portion or even all of the contents of reaction chamber 16 were to be ingested by the user, no detrimental effects would occur other than an altering of the taste of the beverage which would definitely be sensed by the average user. However, inadvertent ingestion of the contents of the chamber would not impact the health of the user.

It will now be understood that what has been disclosed herein is an improved, self-cooling container wherein the improvement comprises a unique structural configuration wherein a beverage to be cooled is caused to flow through a flow tube which is entirely surrounded, but physically isolated from chemical materials undergoing a selectively initiated endothermic reaction. As a consequence thereof, cooling efficiency attained using the present invention is significantly improved rendering the structure of the present invention much more commercially feasible than similar structures of the prior art. Furthermore, the present invention may be constructed so that all of the features therein which are utilized for adding the self-cooling capability to, for example, a conventional aluminum can container, can be affixed to the lid or top thereof, thereby permitting mass production of such beverage containing cans in a relatively conventional manner. More specifically, the structure of the present invention comprises a self-cooling container in which a segregating wall is used to divide the container into a beverage chamber and a cooling chamber, the latter having a reaction chamber mounted therein, which in a preferred embodiment is of an elongated cylindrical shape.

The reaction chamber cylinder of the present invention provides an inverted funnel-shaped bottom surface for receiving the flow of beverage from the beverage chamber portion of the container through a feed-through at the bottom of the segregating wall thereof. The funnel leads to a flow tube which is positioned in axial alignment with the cylinder, preferably through the center thereof and defining an inner wall of the reaction chamber. The reaction chamber houses a combination of chemical materials separated by a readily broken sealing device from a selected volume of distilled water, which when released into the chemical constituents, initiates an endothermic reaction which extracts heat from the beverage. Most efficient heat transfer occurs to that portion of the beverage which flows through the flow tube on its way to a collection chamber immediately adjacent the user-opened closure through which the user has access to the beverage in the container.

In a preferred embodiment, the endothermic chemical constituents are ammonium nitrate, potassium perchlorate and urea and the liquid that is used to initiate the endothermic reaction of these constituents is distilled water. An initiating rod extends through the reaction chamber to a point abutting a sealed seam in the seal separating the distilled water from the chemical materials. The rod is used to break the seal when the user presses the rod cap which extends through the top of the container at a point preferably hidden beneath the container's opening device until the container is opened by the user.

Those having skill in the art to which the present invention pertains will, as a result of the applicants' teaching herein, now perceive various modifications and additions which may be made to the invention. By way of example, the specific shape and configuration of the container as well as of the reaction chamber, and the specific contents and volume of the contents within the reaction chamber may all be varied while still preserving the principal advantageous feature of the invention. Such feature is a structure which permits the flow of beverage along a path which is entirely surrounded by the endothermic reacting materials to substantially increase the efficiency of heat transfer between the beverage and such materials. Accordingly, all such modifications and additions which may be made to the invention are deemed to be within the scope thereof which is to be limited only by the claims appended hereto.

We claim:

1. An improved self-cooling beverage container of the type having an interior wall segregating the container into first and second chambers with a flow path therebetween and having an endothermic reaction-containing body within the first such chamber for cooling the beverage as it exits the container; the improvement comprising:

a reaction-containing body having a flow-tube therethrough and forming a cooling jacket symmetrically surrounding said flow tube for directly cooling the entire surface of said flow tube and thus improving heat transfer from said beverage to said body.

2. The improvement recited in claim 1 wherein said reaction-containing body is in the shape of an elongated cylinder and wherein said flow tube is colinear with the axis of said cylinder.

3. The improvement recited in claim 2 further comprising means in said cylinder for routing said beverage into said flow-tube as said beverage passes from said second chamber into said first chamber.

4. The improvement recited in claim 3 wherein said means for routing comprises a cone-shaped entrance to said cylinder, said entrance being in fluid communication with said flow tube.

5. The improvement recited in claim 4 wherein said flow path between said first and second chambers is located adjacent said cone-shaped entrance.

6. The improvement recited in claim 1 further comprising means for initiating an endothermic reaction within said body.

7. The improvement recited in claim 6 wherein said initiating means is accessible at the top of the container after the container top is opened.

8. The improvement recited in claim 1 wherein said flow-tube terminates below the top of said container and wherein said container further comprises a collection chamber between said flow-tube and said container top.

9. The improvement recited in claim 1 further comprising means within said container for promoting flow of said beverage from said second chamber into said first chamber.

10. The improvement recited in claim 9 wherein said flow promoting means comprises a sloping interior surface along the bottom of said second chamber, said sloping interior surface directing beverage within said second chamber toward said flow path between said first and second chambers.

11. An endothermic-reaction-containing device for use in self-cooling beverage containers of the type which can be selectively activated for cooling a beverage contained therein; the device comprising:

inner and outer tubes having substantially parallel axes, the outer tube completely encircling the inner tube to form an enclosed chamber therebetween for holding a mixture of endothermically reactive materials, said inner tube providing a flow channel for said beverage to be cooled upon contact with said inner tube.

12. The device recited in claim 11 further comprising means for segregating said chamber into two isolated compartments for preventing said endothermic reaction and means for selectively breaching said segregating means for initiating said endothermic reaction.

13. The device recited in claim 11 further comprising means for directing said beverage into said inner tube.

14. The device recited in claim 11 wherein said mixture of materials comprises water, ammonium nitrate, potassium perchlorate and urea.

15. The device recited in claim 14 further comprising means for isolating said water from said remaining materials until it is desired to initiate said endothermic reaction.

16. A self-cooling beverage container comprising:

means for segregating the interior of said container into first and second chambers having a flow path therebetween;

means in said first chamber providing a beverage channel;

a cooling jacket parallel to said beverage channel and encircling said beverage channel; and means in said cooling jacket for selectively activating an endothermic chemical reaction;

said reaction activating means being in direct contact with said beverage channel along the entire surface of said beverage channel.

17. The container recited in claim 16 wherein said cooling jacket comprises an elongated cylinder and wherein said beverage channel is parallel to the axis of said cylinder.

18. The container recited in claim 17 wherein a first axial end of said cylinder is positioned adjacent said flow path.

19. The container recited in claim 18 wherein said first axial end of said cylinder is conically shaped and wherein the apex of said conically shaped cylinder end is truncated and is in fluid communication with said beverage channel.

20. The container recited in claim 17 wherein said beverage channel is colinear with the axis of said cylinder.

21. The container recited in claim 16 wherein said selectively activating means comprises a breakaway seal segregating said cooling jacket into two isolated compartments and means for selectively breaking said seal.

22. The container recited in claim 21 wherein said seal breaking means is accessible externally of said container.

23. The container recited in claim 18 further comprising means for opening said container, said cylinder having a second axial end adjacent said container opening means, said beverage channel being in fluid communication with said opening means.

* * * * *